US005782254A

United States Patent [19]

Tanikawa et al.

[11] Patent Number: 5,782,254

[45] Date of Patent: Jul. 21, 1998

[54] RECYCLABLE IMAGE RECORDING SUPPORT MATERIAL, METHOD OF PRODUCING THE SAME, AND METHOD OF RECYCLING THE RECYCLABLE IMAGE RECORDING MATERIAL

[75] Inventors: Kiyoshi Tanikawa; Tadashi Saito, both of Yokohama; Shigeru Fujita, Tokyo; Kakuji Murakami, Kamakura; Mitsuru Ohminato, Yokohama, all of Japan

[73] Assignee: Ricoh Company, Ltd., Tokyo, Japan

[21] Appl. No.: 535,732

[22] Filed: Sep. 28, 1995

[30] Foreign Application Priority Data

Sep. 28, 1994 [JP] Japan ..... 6-258792
Jan. 9, 1995 [JP] Japan ..... 7-017548

[51] Int. Cl.[6] ..... B08B 3/00

[52] U.S. Cl. ..... 134/109; 134/10; 134/39; 134/105; 427/140; 427/371; 427/372.2; 427/384; 428/388.4; 428/389; 428/391; 428/395; 428/211; 428/537.5

[58] Field of Search ..... 427/140, 372.2, 427/371, 384, 388.4, 389.9, 391, 395; 134/10, 15, 39, 105, 109; 428/211, 537.5

[56] References Cited

U.S. PATENT DOCUMENTS 5,474,617 12/1995 Saito et al. ..... 134/15

*Primary Examiner*—E. Rollins Buffalow

*Attorney, Agent, or Firm*—Oblon, Spivak, McClelland, Maier & Neustadt, P.C.

[57] ABSTRACT

A method of producing a recyclable image recording support material including a paper layer capable of copying or recording images thereon is conducted by the steps of applying to an image-bearable side of an image recording support material including a paper layer an aqueous coating liquid selected from the group consisting of an aqueous surfactant solution, an aqueous water-soluble polymer solution, and a mixture of the aqueous surfactant solution and the aqueous water-soluble polymer solution, in an extremely small amount; removing images, if any, from the image-bearable side of the image recording support material by bringing an image releasing member into contact with the image-bearable side of the image recording support material under application of heat and pressure thereto; and drying the image recording support material. An image recording support material is produced by the above method. A method of recyling an image recording support material, based on the above method, is also conducted. An apparatus for producing a recyclable image recording support material and an apparatus for recycling an image recording support material for use in practice are made.

35 Claims, 5 Drawing Sheets

RECYCLABLE IMAGE RECORDING SUPPORT MATERIAL, METHOD OF PRODUCING THE SAME, AND METHOD OF RECYCLING THE RECYCLABLE IMAGE RECORDING MATERIAL

BACKGROUND OF THE INVENTION

1. Field of the Invention

The present invention relates to a method and an apparatus for recycling an image recording support material comprising a paper layer capable of copying or recording thermosoftening ink images thereon, and particularly, a method and apparatus capable of successively removing the images from the image recording support material and producing a recyclable image recording support material. In addition, the present invention relates to a recyclable image recording material produced by the above-mentioned method.

2. Discussion of Background

Because of recent rapid development of office automation, a large quantity of papers for printers and copying machines has been used and consumed. This has caused the problems of the environmental disruption of the earth due to deforestation.

Conventionally, in order to recycle papers of this kind, printed ink is removed from the paper, and the ink-free paper is crushed and paper is made therefrom again. This has been an only method of recycling this kind of paper materials.

However, recently a method for recycling used copy papers by cleaning printed images off the surface of the copy paper has been developed, and examples of such a recycling method have been described, for instance, in the following references:

(1) Japanese Laid-Open Patent Application 4-67043:

There is proposed a sheet-shaped recording material for supporting images thereon. This recording material can be used as a copy paper, with one surface side thereof being treated so as to be made image-releasable. In this recording material, a special mark is placed in order to distinguish it from plain copy paper. However, this special recording paper in surface-treated by coating of a solution containing a matter soluble in an organic solvent. Therefore, such a treatment is liable to cause ignition, give out a bad small, so that the labor environment is impaired by being filled with the organic solvent employed.

(2) Japanese Laid-Open Patent Applications 1-101576 and 1-101577:

A toner-image-bearing copy paper is immersed into an organic solvent in which the toner resin contained in the toner images of the toner-image-bearing copy paper is soluble, and is then subjected to an ultrasonic wave treatment, thereby removing toner images from the copy paper. This method, however, has the shortcoming that organic solvents used cause air pollution problems and are ignitable and toxic, accordingly not suitable for office or home use.

(3) Japanese Laid-Open Patent Application 1-297294:

In this application, plastics, metal, paper into which liquids hardly penetrate, and ceramics are employed as the support of a toner-image-bearing member, and toner images formed on the support are heated through a thermofusible releasing member, whereby toner images are peeled off the support and the support is cleaned. In this method, however, a special erasable paper subjected to releasing treatment has to be used. Therefore, this method has the shortcoming that it cannot be applied to a large quantity of copy paper and printing paper now in general use.

(4) Japanese Laid-Open Patent Application 5-202557:

The inventors of the present invention have proposed a method for recycling an image-deposited recording material comprising at least a surface portion of which comprises a paper layer containing cellulose fibers and bearing hydrophobic images thereon, formed by a thermosoftening ink such as a toner. By this method, the paper layer on which hydrophobic images are deposited is impregnated with a water-containing liquid, and the hydrophobic images are peeled from the paper layer of the recording material by using an image release means. The above-mentioned recycling method is achieved by impregnating the image-deposited paper layer with the water-containing liquid, that is, an aqueous solution comprising a surfactant at relatively low concentrations at one-time operation. In practice, however, the whole image-deposited recording material is wetted with the aqueous solution for image removal, and the amount of the water-containing liquid penetrating to the interface of the paper layer with the hydrophobic images is more than needed. After image peeling or removing step, therefore, a large quantity of energy is required to dry the recording material so as to be ready for the next image forming operation. The electric power consumed by an apparatus for achieving the above-mentioned recycling method is increased. If the heating step is not enough to dry the recording material after the image peeling stop, the problems of wrinkles, waving and elongation of the recording material are caused while in use, and consequently, the paper jamming problem often takes place when such a recording material is again subjected to copying operation.

To solve the above-mentioned problems, it is necessary to provide a means for heating and drying the recording material after the images are peeled off from the recording material. When such a heating and drying means is incorporated in the recycling apparatus, the apparatus becomes large in size, and the recycling cost increases.

SUMMARY OF THE INVENTION

It is therefore a first object of the present invention to provide a method of producing a recyclable image recording support material comprising a paper layer by use of an extremely small amount of a water component and therefore by use of a minimum power consumption for drying the image recording support material.

A second object of the present invention is to provide a recyclable image recording material comprising a paper layer which requires an extremely small amount of a water component and a minimum power consumption when recycled.

A third object of the present invention in to provide a method of recycling an image recording support material comprising a paper layer by use of an extremely small amount of a water component and therefore by use of a minimum power consumption for drying the image recording support material.

A fourth object of the present invention is to provide an apparatus for recycling the above-mentioned recyclable image recording support material, which requires an extremely small amount of a water component and a minimum power consumption when recycled.

A fifth object of the present invention is to provide an apparatus for producing a recyclable image recording support material which requires an extremely small amount of a water component and a minimum power consumption when recycled.

The first object of the present invention can be achieved by a method of producing a recyclable image recording support material comprising a paper layer capable of copying or recording images thereon, comprising the steps of (a) applying to an image-bearable side of an image recording support material comprising a paper layer an aqueous coating liquid selected from the group consisting of an aqueous surfactant solution comprising a surfactant with a concentration in the range of 0.1 wt. % or more, and an aqueous water-soluble polymer solution comprising a water-soluble polymer with a concentration of 0.1 to 60 wt. %, and a mixture of the aqueous surfactant solution and the aqueous water-soluble polymer solution, in an effective trace amount; (b) removing images, if any, from the image-bearable side of the image recording support material by bringing image releasing means into contact with the image-bearable side of the image recording support material under application of heat and pressure thereto; and drying the image recording support material.

When the image recording material to be recycled does not bear images thereon, the step of removing images is unnecessary.

The second object of the present invention can be achieved by a recyclable image recording support material comprising a paper layer capable of copying or recording images thereon, which is produced by the above-mentioned method.

The third object of the present invention can be achieved by a method of recycling an image recording support material comprising a paper layer which is capable of copying or recording images on one or both sides thereof and bears images thereon, comprising the steps of (1) applying to an image-bearing side of the image recording support material an image removal acceleration liquid selected from the group consisting of (a) water, (b) an aqueous surfactant solution comprising a surfactant, (c) an aqueous water-soluble polymer solution comprising a water-soluble polymer, and (d) an aqueous surfactant and water-soluble polymer solution comprising a surfactant and a water-soluble polymer; (2) bringing image releasing means into contact with the image removal acceleration liquid applied image-bearing side of the image recording support material under application of heat and pressure thereto, while the image bearing side of the image recording support material is wetted with the image removal acceleration liquid, thereby peeling images away from the image recording support material by the image releasing means, and (3) drying the image recording support material by the image releasing means simultaneously with the peeling of the images, thereby recycling the image recording support material in such a manner so as to be successively usable for copying or recording.

When the image recording material to be recycled does not bear images thereon, the step of peeling images away from the image recording material is unnecessary.

The fourth object of the present invention can be achieved by a recycling apparatus for recycling an image recording support material which is capable of copying or recording images one or both sides thereof and which bears images thereon, comprising (1) water-containing image removal acceleration liquid application means for applying to the image-bearing side of the image recording support material a water-containing image removal acceleration liquid selected from the group consisting of (a) water, (b) an aqueous surfactant solution comprising a surfactant, (c) an aqueous water-soluble polymer solution comprising a water-soluble polymer, and (d) an aqueous surfactant and water-soluble polymer solution comprising a surfactant and a water-soluble polymer in such an amount that the amount of water applied to the image-bearing side of the image recording support material is in the range of 0.08 to 0.4 g per A4 size of the image recording support material; and (2) image releasing and drying means for removing images from the image-bearing side of the image recording support material, with the image releasing and drying means being brought into contact with the image-bearing side of the image recording support material under application of heat and pressure, while the image-bearing side of the image recording support material is wetted with the image removal acceleration liquid, thereby removing the images from the image recording support material, and for drying the image recording support material, thereby recycling the image recording support material in such a manner so as to be successively usable for copying or recording.

The above recycling apparatus may further comprise a copying or recording means for copying or recording images on the recycled image recording support material.

When the image recording material to be recycled does not bear images thereon, the image releasing and drying means which is capable of peeling images away from the image recording material is unnecessary.

The fifth object of the present invention can be achieved by an apparatus for producing a recyclable image recording support material comprising a paper layer capable of copying or recording images thereon, comprising (a) aqueous coating liquid application means for applying to an image-bearable side of an image recording support material an aqueous coating liquid selected from the group consisting of an aqueous surfactant solution comprising a surfactant with a concentration in the range of 0.1 wt. % or more, and an aqueous water-soluble polymer solution comprising a water-soluble polymer with a concentration of 0.1 to 60 wt. %, and a mixture of the aqueous surfactant solution and the aqueous water-soluble polymer solution, in an effective trace amount; (b) image releasing and drying means for removing images, if any, from the image-bearable side of the image recording support material, with the image releasing means being brought into contact with the image-bearable side of the image recording support material under application of heat and pressure, while the image-bearable side is wetted with the aqueous coating liquid, thereby removing the images, if any, from the image-bearable side of the image recording support material, and for drying the image recording support material, thereby producing a recyclable image recording support material which is successively usable for copying or recording.

When the image recording material to be recycled for the production of the recyclable image recording support material does not bear images thereon, the image releasing and drying means which is capable of peeling images away from the image recording material in unnecessary.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
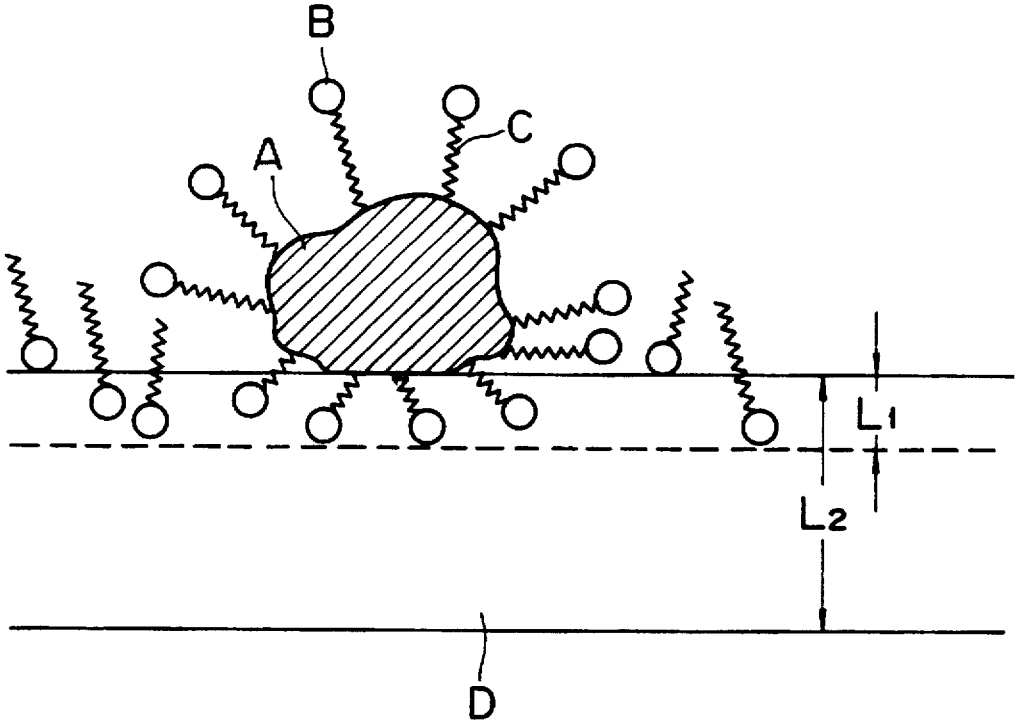
FIG. 1 is a schematic view which shows the adsorption phenomenon of a surfactant to a toner image and a cellulose-fibers-containing paper layer of the image recording support material.

A method of producing a recyclable image recording support material, which comprises a paper layer capable of copying or recording images thereon, of the present invention comprises the steps of: (a) applying to an image-bearable side of an image recording support material comprising a paper layer an aqueous coating liquid selected from the group consisting of an aqueous surfactant solution comprising a surfactant with a concentration in the range of 0.1 wt. % or more, and an aqueous water-soluble polymer solution comprising a water-soluble polymer with a concentration of 0.1 to 60 wt. %, and a mixture of the aqueous surfactant solution and the aqueous water-soluble polymer solution, in an effective trace amount; (b) removing images, if any, from the image-bearable side of the image recording support material by bringing image releasing means into contact with the image-bearable side of the image recording support material under application of heat and pressure thereto; and drying the image recording support material.

When the image recording material to be recycled does not bear images thereon, the stop of removing images is unnecessary, so that the method of producing the recyclable image recording support material of the present may be a method of producing a recyclable image recording support material comprising a paper layer capable of copying or recording images thereon, comprising the step of applying to an image-bearable side of an image recording support material comprising a paper layer an aqueous coating liquid selected from the group consisting of an aqueous surfactant solution comprising a surfactant with a concentration in the range of 0.1 wt. % or more, and an aqueous water-soluble polymer solution comprising a water-soluble polymer with a concentration of 0.1 to 60 wt. %, and a mixture of the aqueous surfactant solution and the aqueous water-soluble polymer solution, in an effective trace amount.

When the image recording material to be recycled bears images thereon, the above-mentioned aqueous surfactant solution also serves as an image removal acceleration liquid to remove images from the image recording support material. Just for the removal of images from the image recording support material, water may be employed.

Furthermore, since the amount of the aqueous coating liquid to be applied to the image recording support material is extremely small in the present invention, the aqueous coating liquid applied image recording support material can be usually dried by allowing it to stand at room temperature for several seconds, without requiring any particular additional drying means.

In the above method of producing the recyclable image recording support material, the image recording support material coated with the aqueous coating liquid may be dried by the above-mentioned image releasing means which is brought into contact with the image recording support material.

Further, in the above method, it is preferable that the aqueous coating liquid be applied to the image recording support material in such an amount that the amount of water applied to the image-bearable side of the image recording support material is in the range of 0.06 to 0.4 g per A4 size of the image recording support material; in such an amount that the amount of the surfactant applied to the image-bearable side of the image recording support material is in the range of 0.01 to 0.4 g per A4 size of the image recording support material; or in such an amount that the amount of the water-soluble polymer applied to the image-bearable side of the image recording support material is in the range of 0.01 to 1 g per A4 size of the image recording support material.

A recyclable image recording support material of the present invention comprises a paper layer capable of copying or recording images thereon, which is produced by the above-mentioned producing method.

A method of recycling an image recording support material comprising a paper layer which is capable of copying or recording images on one or both sides thereof and bears images thereon, of the present invention comprises the steps of: (1) applying to an image-bearing side of the image recording support material an image removal acceleration liquid selected from the group consisting of (a) water, (b) an aqueous surfactant solution comprising a surfactant, (c) an aqueous water-soluble polymer solution comprising a water-soluble polymer, and (d) an aqueous surfactant and water-soluble polymer solution comprising a surfactant and a water-soluble polymer; (2) bringing image releasing means into contact with the image removal acceleration liquid applied image-bearing side of the image recording support material under application of heat and pressure thereto, while the image bearing side of the image recording support material is wetted with the image removal acceleration liquid, thereby peeling images away from the image recording support material by the image releasing means, and (3) drying the image recording support material by the image releasing means simultaneously with the peeling of the images, thereby recycling the image recording support material in such a manner so as to be successively usable for copying or recording.

When the image recording material to be recycled does not bear images thereon, the step of peeling images away from the image recording material is unnecessary.

In this case, only an aqueous surfactant solution comprising a surfactant, an aqueous water-soluble polymer solution comprising a water-soluble polymer, or an aqueous surfactant and water-soluble polymer solution comprising a surfactant and a water-soluble polymer is effective for recycling the image recording support material in the above-mentioned method.

Furthermore, since the amount of the aqueous coating liquid to be applied to the image recording support material is extremely small in the present invention, the aqueous coating liquid applied image recording support material can be usually dried by allowing it to stand at room temperature for several seconds, without requiring any particular additional drying means.

In the above recycling method, it is preferable that the image removal acceleration liquid be applied to the image recording support material in such an amount that the amount of water applied to the image bearing side of said image recording support material is in the range of 0.08 to 0.4 g per A4 size of the image recording support material; in such an amount that the amount of the surfactant applied to the image bearing side of the image recording support material is in the range of 0.06 to 0.4 g per A4 size of the image recording support material; or in such an amount that the amount of the water-soluble polymer applied to said image bearing side of the image recording support material is in the range of 0.01 to 0.4 g per A4 size of the image recording support material.

Furthermore, in the above-mentioned recycling method of the present invention, it is preferable that the aqueous surfactant solution comprise a surfactant with a concentration of 0.01 to 20 wt. % and/or that the aqueous water-soluble polymer solution comprise a water-soluble polymer with a concentration of 0.01 to 20 wt. %.

A recycling apparatus for recycling an image recording support material which is capable of copying or recording images one or both sides thereof and which bears images thereon, of the present invention comprises (1) water-containing image removal acceleration liquid application means for applying to the image-bearing side of the image recording support material a water-containing image removal acceleration liquid selected from the group consisting of (a) water, (b) an aqueous surfactant solution comprising a surfactant, (c) an aqueous water-soluble polymer solution comprising a water-soluble polymer, and (d) an aqueous surfactant and water-soluble polymer solution comprising a surfactant and a water-soluble polymer in such an amount that the amount of water applied to the image-bearing side of the image recording support material is in the range of 0.08 to 0.4 g per A4 size of the image recording support material; and (2) image releasing and drying means for removing images from the image-bearing side of the image recording support material, with the image releasing means being brought into contact with the image-bearing side of the image recording support material under application of heat and pressure, while the image-bearing side of the image recording support material is wetted with the image removal acceleration liquid, thereby removing the images from the image recording support material, and for drying the image recording support material, thereby recycling the image recording support material in such a manner so as to be successively usable for copying or recording.

The above recycling apparatus may further comprise a copying or recording means for copying or recording images on the recycled image recording support material.

When the image recording material to be recycled does not-bear images thereon, the image releasing and drying means which is capable of removing or peeling images away from the image recording material is unnecessary. Furthermore, since the amount of the aqueous coating liquid to be applied to the image recording support material is extremely small in the present invention, the aqueous coating liquid applied image recording support material can be usually dried by allowing it to stand at room temperature for several seconds. Therefore, in this case, the above image releasing and drying means can be omitted from the above-mentioned recycling apparatus.

An apparatus for producing a recyclable image recording support material comprising a paper layer capable of copying or recording images thereon, of the present invention comprises (a) aqueous coating liquid application means for applying to an image-bearable side of an image recording support material an aqueous coating liquid selected from the group consisting of an aqueous surfactant solution comprising a surfactant with a concentration in the range of 0.1 wt. % or more, and an aqueous water-soluble polymer solution comprising a water-soluble polymer with a concentration of 0.1 to 60 wt. %, and a mixture of the aqueous surfactant solution and the aqueous water-soluble polymer solution, in an effective trace amount; (b) image releasing and drying means for removing images, if any, from the image-bearable side of the image recording support material, with the image releasing means being brought into contact with the image-bearable side of the image recording support material under application of heat and pressure, while the image-bearable side is wetted with the aqueous coating liquid, thereby removing the images, if any, from the image-bearable side of the image recording support material, and for drying the image recording support material, thereby producing a recyclable image recording support material which is successively usable for copying or recording.

When the image recording material to be recycled for the production of the recyclable image recording support material does not bear images thereon, the image releasing and drying means which is capable of removing from the image recording material is unnecessary.

Furthermore, since the amount of the aqueous coating liquid to be applied to the image recording support material is extremely small in the present invention, the aqueous coating liquid applied image recording support material can be usually dried by allowing it to stand at room temperature for several seconds. Therefore, in this case, the above image releasing and drying means can be omitted from the above-mentioned apparatus.

The image recording support material for use in the present invention is not always required to be composed of a paper layer in its entirety, but there may be employed an image recording support material comprising at least a paper layer which comprises as the main component cellulose fibers on which hydrophobic images composed of a thermosoftening ink such as toner are supported. Therefore, the image recording support material may be composed of a paper layer and a plastics layer which are overlaid.

Generally, when the paper layer which comprises as the main component cellulose fibers is wetted with water, the stiffness of the paper is decreased. When the paper layer bears hydrophobic images and is wetted with water, the adhesion between the hydrophobic images composed of a hydrophobic thermosoftening ink and the paper layer which bears a surfactant and/or a water-soluble polymer on the surface or in the vicinity to the surface thereof is significantly decreased.

In other words, in the paper layer which comprises as the main component cellulose fibers, the intertwinement of the cellulose fibers forms countless fine concave and convex portions on the surface of the paper layer and countless fine voids inside the paper layer.

When hydrophobic toner images are formed on the surface of the paper layer in the above-mentioned state and fixed thereto by a plain paper copying process, the fixed toner images are larger than the concave and convex portions on the surface of the paper layer, so that there formed a number of voids between the toner images and the cellulose fibers of the paper layer and between the toner images and the surface of the paper layer in the toner image fixed portions.

When the previously mentioned water-containing image removal acceleration liquid is applied or sprayed to the hydrophobic-image-bearing recording material, or the hydrophobic-image-bearing recording material in immersed into the water-containing image removal acceleration liquid, the liquid penetrates into the cellulose fibers and the voids between the cellulose fibers, and reaches the contact portions between the cellulose fibers and the hydrophobic images by capillarity.

When there are surfactant or water-soluble polymer applied portions on the surface of the paper layer or in the vicinity to the surface thereof, and portions free from a surfactant or water-soluble polymer on the paper layer, significantly larger penetration force works in the surfactant or water-soluble polymer applied portions than in the portions free from such a surfactant or water-soluble polymer on the paper layer.

As a result, when the above liquid penetrates into the cellulose fibers, the cellulose fibers swell and are deformed, so that the space between the cellulose fibers and the hydrophobic images is increased, or the contact areas between the two are significantly decreased. The result is that the adhesion between the hydrophobic images and the cellulose fibers is significantly decreased.

For sufficient wetting with water of an image-bearing paper sheet which bears images composed of a thermosoftening ink such as toner (hereinafter referred to as toner images) in a short time, the water wettability of the image-bearing paper sheet is an important factor.

In order to peel the toner images away from the image-bearing paper sheet, it is necessary to cause a sufficient amount of water to penetrate into the boundary portion between the toner images and the paper sheet.

In the present invention, in order to accelerate the peeling of the toner images away from the paper sheet, a surfactant, a water-soluble polymer, or both a surfactant and a water-soluble polymer are deposited on or near the surface of the paper sheet, it is preferable to form copied or recorded images thereon.

Therefore, in the present invention, a water-containing image removal acceleration liquid comprising a surfactant is employed for the removal of the toner images from the image recording support material with improved capillarity which is essential for effective peeling of images therefrom.

According to the method of producing a recyclable image recording support material of the present invention, the aqueous coating liquid selected from the group consisting of a surfactant solution comprising a surfactant with a concentration of 0.1 wt. % or more, an aqueous water-soluble polymer solution comprising a water-soluble polymer with a concentration of 0.1 to 60 wt. %, and a mixture of the surfactant solution and the aqueous water-soluble polymer solution is applied in an effective trace amount to an image-bearable side of the image recording support material comprising a paper layer. In this case, it is preferable that the amount of water applied to the image-bearable side of the image recording support material be in the range of 0.06 to 0.4 g per A4 size of the image recording support material.

When the image recording support material of the present invention bears a toner image thereon, as shown in FIG. 1, a hydrophobic thermosoftening ink A is deposited on a cellulose-fibers-containing paper layer D of the image recording support material. Suppose that an aqueous surfactant solution is applied to the cellulose-fibers-containing paper layer D on which the ink A is deposited. In general, a molecule of the surfactant is composed of a hydrophilic group and a hydrophobic group, that is, a lipophilic group. In this case, as shown in FIG. 1, the hydrophobic thermosoftening ink A adsorbs a hydrophilic group C of the surfactant, while the hydrophilic group B of the surfactant is attracted to hydroxyl group of a surface portion of the cellulose-fibers-containing paper layer D. As the result of such adsorbing phenomenon, the surfactant can sufficiently penetrate through the boundary portion between the hydrophobic thermosoftening ink A and the cellulose fibers, and the surface of each cellulose fiber covered with the hydrophobic thermosoftening ink A. According to the present invention, the surfactant does not permeate through the cellulose-fibers-containing paper layer D extending over the entire thickness of $L_2$, but permeates through a surface portion with a thickness of $L_1$.

According to the present invention, when water or the aqueous solution of the surfactant and/or water-soluble polymer, namely, the image removal acceleration liquid is applied to the hydrophobic thermosoftening ink image to remove it from the paper layer of the image recording support material, the applied amount of water may be as small as 0.08 to 0.4 g per A4 size of the image recording support material. After the application of the image removal acceleration liquid, the thermosoftening ink tends to dissolve into the aqueous image removal acceleration liquid, and consequently, the toner image starts to float. Therefore, the image removal acceleration liquid further permeates through the boundary portion between the toner image and each cellulose fiber, so that the toner image can be readily peeled from the cellulose fibers. Thus, the toner image deposited on the image recording support material can be removed therefrom without impairing the paper layer. Furthermore, only the surface portion of the paper layer is wetted with the image removal acceleration liquid, as previously mentioned, so that the thermal energy required to dry the image recording support material after the image peeling step can be remarkably decreased. When the amount of water applied to the image recording support material is within the above-mentioned range, the obtained image recording support material can be protected from some changes, for example, elongation, wrinkles and waving, and the image recording support material can be ready for copying and recording merely by allowing it to stand at room temperature for several seconds without any heating, pressing or particular additional drying operation. As a result, the power consumption of the recycling apparatus of the present invention can be decreased, and the apparatus for recycling such an image recording support material can be decreased in size. This enables the recycling cost to be drastically reduced.

When the aqueous surfactant solution is employed an the aqueous image removal acceleration liquid for recycling the image recording support material, it is preferable that the aqueous surfactant solution comprise a surfactant with a concentration of 0.01 to 20 wt. %, more preferably 0.01 to 5 wt. %. Generally, excessively high concentration of the surfactant in the aqueous surfactant solution is not preferable because it is liable to impart electroconductivity to the recycled image recording support material. According to the present invention, however, it is possible to apply the image removal acceleration liquid to the image recording support material by two steps in such a manner that a relatively concentrated solution of the surfactant is very lightly applied to the image recording support material at the first step, and then a relatively diluted aqueous solution is further applied to the image recording support material at the second step. Therefore, a large amount of the surfactant first applied to the image recording support material is properly diluted, so that electroconductivity is not imparted to the image recording support material by the surfactant.

When the aqueous solution comprising a water-soluble polymer is caused to be held on the image-bearing side of the image recording support material while the water component remains in the image recording support material, the toner images composed of a thermosoftening ink can be easily peeled from the image recording support material with the water-soluble polymer serving as an intermediate release member for the toner images deposited on the image recording support material. To be more specific, the thermosoftening ink adhering to the depths of cellulose fibers, which cannot come into direct contact with the image releasing member, is brought into contact with the water-soluble polymer. Owing to the viscosity of the water-soluble polymer, the thermosoftening ink can be attached to the water soluble polymer and transferred to the image releasing member together when the image releasing member is brought into contact with the water-soluble polymer. The image formed by the thermosoftening ink can be thus removed from the cellulose fibers without impairing the quality of paper.

It is preferable that the aqueous water-soluble polymer solution serving as the image removal acceleration liquid comprise a water-soluble polymer with a concentration of 0.01 to 20 wt. %, more preferably 0.5 to 10 wt. %. When the concentration of the water-soluble polymer is excessively high, the viscosity of the aqueous solution increases, which hinders the penetration of the aqueous solution into the image recording support material.

The above-mentioned water-soluble polymer in used as a sizing agent in the paper industry. The surface of paper is never impaired by such a water-soluble polymer; rather, the water-soluble polymer serves to improve the surface quality of paper.

Representative examples of such a water-soluble polymer are shown in the following Table 1. The water-soluble polymers for use in the present invention are not limited to those as shown in Table 1.

TABLE 1

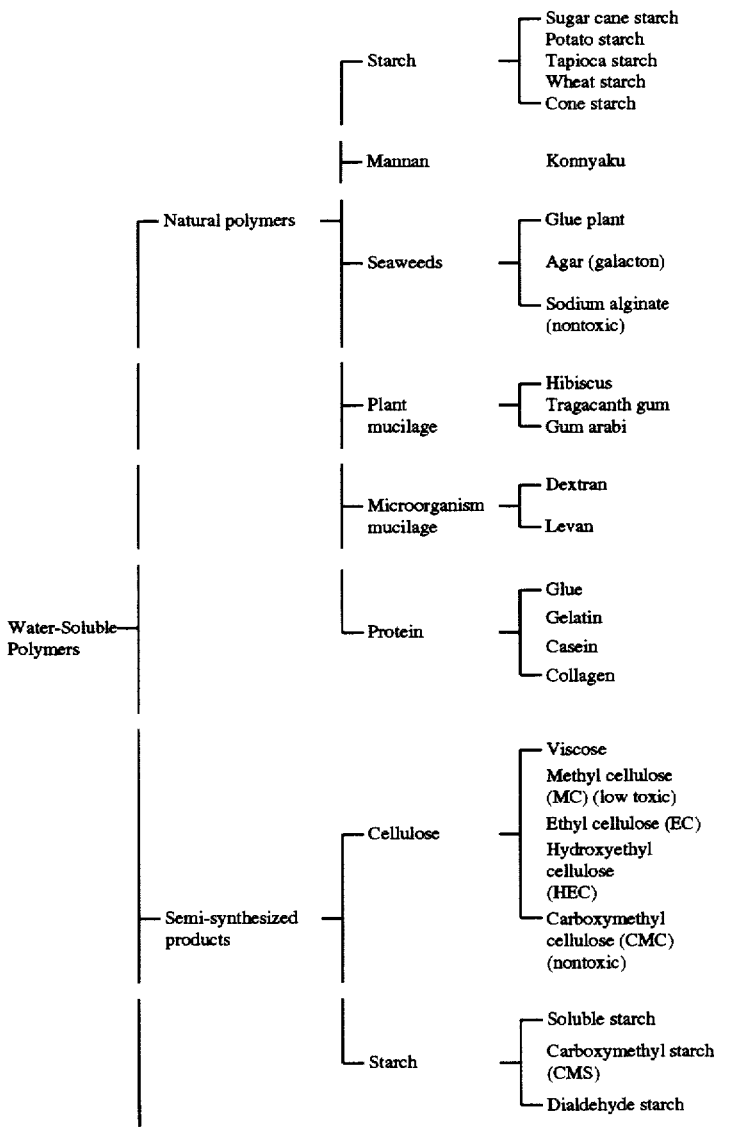

TABLE 1-continued

| | |
|---|---|
| Synthesized products | Polyvinyl alcohol (poval)<br>Sodium polyacrylate<br>Polyethylene oxide<br>Isobutylene-maleic anhydride copolymer |

The image releasing and drying means for use in the present invention is mean for removing the toner images from the image recording support material by transferring the images to an image releasing and drying member when the image releasing and drying member having adhesion properties to the toner images is brought into contact with the toner images with the application of heat and/or pressure thereto. By the image releasing and drying means, the obtained recyclable image recording support material can be simultaneously dried.

Examples of a material constituting such an image releasing and drying member include organic high-molecular materials, particularly, a high-molecular material with substantially the same SP value as that of a constituting material of the toner image; and inorganic materials such as a metallic material with high surface activity energy, a material deposited with the above-mentioned metallic material, and ceramics.

As the organic high-molecular materials for use in the image releasing member for use in the present invention, there can be employed the above-mentioned water-soluble polymers, resin components contained in the thermosoftening ink, or resin components contained in adhesive agents as stated below. As for the resin used for the image releasing member, whether the resin may be water-soluble or not, it can be used so long as it has the adhesion properties to the toner images formed on the image recording support material.

Specific examples of the resin components contained in the adhesive agents are protein-based resins such as glue, gelatin, albumin and casein; carbohydrate-based resins such as starch, cellulose, and complex polysaccharide including gum arabic and gum tragacanth; thermoplastic resins such as vinyl acetate polymer and copolymer, acrylic copolymer, ethylenic copolymer, polyamide, polyester, and polyurethane; and rubbers such as polychloroprene rubber, nitrile rubber, reclaimed rubber, styrene—butadiene rubber (SBR), and natural rubber.

The above-mentioned resins used for the image releasing and drying member may be formed into a roller, sheet, belt or tape. Alternatively, such resins may be held on the surface of other support member in the form of a roller, shoot, belt or tape. As such an image releasing member, for example, a rubber-based or acrylic pressure sensitive adhesive agent may be provided on the surface of the support member of cellophane tape, adhesive craft-paper tape, polyvinyl chloride tape, acetate tape, or filament-reinforced tape. In this case, it in preferable that a surface portion of the support member be porous or comprise a porous material. Alternatively, the support member may be surface-treated to have surface roughness or matte-finished. In addition, an expanded resin, in particular, a titanium-oxide containing expanded resin can be used for the image releasing member for use in the present invention, as previously proposed by the inventors of the present invention.

The image removal acceleration liquid used to remove the images from the image recording support material comprises the surfactant and/or the water-soluble polymer. A broad variety of surfactant can be used in the present invention.

A molecule of the surfactant is generally determined by the combination of a lipophilic group and a hydrophilic group. Table 2 and Table 3 respectively show the examples of the lipophilic group and the hydrophilic group. Both of the lipophilic group and the hydrophilic group are not limited to those groups shown in Tables 2 and 3.

TABLE 2

| lipophilic groups |
|---|
| Hydrocarbon group (mostly, having 6 to 22 carbon atoms. |
| n-alkyl group,<br>branched alkyl group,<br>substituted alkyl group,<br>aromatic group,<br>plural-alkyl-chain group,<br>polyoxyalkylene group,<br>Partially or completely fluorinated alkyl group<br>Polysiloxane |

TABLE 3

| Hydrophilic groups |
|---|
| Anionic groups of: |
| carboxylate,<br>sulfonate,<br>sulfuric ester salt,<br>phosphoric ester salt,<br>phosphonate |
| Cationic groups of: |
| amine salt,<br>quaternary ammonium salt,<br>pyridinium salt,<br>sulfonium salt,<br>phosphonium salt,<br>polyethylene polyamine |
| Amphoteric groups of: |
| amino acid,<br>betaine,<br>aminosulfuric ester,<br>sulfobetaine |
| Nonionic groups of: |
| polyhydric alcohol (glycerin, glucose, sorbitol, and sucrose)<br>amino alcohol<br>polyethylene glycol<br>semi-polar bond (amine oxide, sulfoxide, aminimide) |

From the viewpoint of molecular structure, there can be employed anionic surfactants of a fatty acid derivative type, a sulfuric ester type, a sulfonic acid type, and a phosphoric eater type; cationic surfactants such as quaternary ammonium salts, heterocyclic amines, and amine derivatives; amphoteric surfactants; and nonionic surfactants.

The anionic surfactant is roughly divided into four groups; carboxylate, sulfonate, sulfate, and phosphate.

Specific examples of the anionic surfactant of carboxylate Include soaps, N-acylamino acid and salts thereof, alkyl ether carboxylate and acyl peptide.

Specific examples of the anionic surfactant of sulfonate include alkylsulfonate, alkylbenzenesulfonate, alkylnaphthalenesulfonate, sulfosuccinate, α-olefin sulfonate, and N-acyl sulfonate.

Specific examples of the anionic surfactant of sulfate include sulfonated oil, alkyl sulfate, alkyl ether sulfate, alkylallyl ether sulfate, and alkylamide sulfate.

Specific examples of the anionic surfactant of phosphate include alkyl phosphate, alkyl ether phosphate and alkylallyl ether phosphate.

Examples of the cationic surfactant are alkylamine salt and quaternary ammonium salt thereof, aromatic quaternary ammonium salt, and heterocyclic quaternary ammonium salt.

Examples of the amphoteric surfactant are betaine such as carboxy betaine and sulfobetaine; aminocarboxylate; and imidazoline derivatives.

The nonionic surfactant are divided into the following four groups:

I. Ether type: polyoxyethylene alkyl ether, polyoxyethylene alkylallyl ether, polyoxyethylene alkyl phenol ether formaldehyde condensate, polyoxyethylene polyoxypropylene block polymer, and polyoxyethylene polyoxypropylene alkyl ether.

II. Ether eater type: polyoxyethylene glycerine fatty acid eater, polyoxyethylene sorbitan fatty acid eater and polyoxyethylene sorbitol fatty acid aster.

III. Ester type: polyethylene glycol fatty acid ester, glycerine fatty acid ester, polyglyceryl fatty acid ester, sorbitan fatty acid ester, propylene glycol fatty acid aster, and sucrose fatty acid ester.

IV. Nitrogen-containing type: fatty acid alkanolamide, polyoxyethylene fatty acid amide, polyoxyethylone alkylamine, and alkylamine oxide.

Representative examples of the fluorochemical surfactant for use in the present invention are fluoroalkyl($C_2$–$C_{10}$) carboxylic acid, N-perfluorooctane sulfonylglutamic acid and salts thereof, 3-[fluoroalkyl($C_6$–$C_{11}$)oxy]-1-alkyl ($C_3$–$C_4$)sulfonic acid and salts thereof, 3-[Ω-fluoroalkanoyl ($C_6$–$C_8$)-N-ethylamino]-1-propanesulfonic acid and salts thereof, N-(3-(perfluorooctanesulfonamide)propyl)-N,N-dimethyl-N-carboxymethylene ammonium betaine, fluoroalkyl($C_{11}$–$C_{20}$) carboxylic acid, perfluoroalkyl ($C_7$–$C_{13}$) carboxylic acid, perfluorooctanesulfonic acid diethanolamide, perfluoroalkyl($C_4$–$C_{12}$)sulfonate (Li, K, and Na), N-propyl-N-(2-hydroxyethyl) perfluorooctanesulfonamide, perfluoroalkyl($C_6$–$C_{10}$) sulfonamide propyltrimethylammonium salt, perfluoroalkyl ($C_6$–$C_{10}$)-N-ethylsulfonylglycine salt (K), bis(N-perfluorooctylsulfonyl-N-ethylaminoethyl)phosphate, and monoperfluoroalkyl($C_6$–$C_{16}$)ethyl phosphate.

Examples of the silicone surfactant for use in the present invention are shown in the following Table 4:

TABLE 4

General Formula

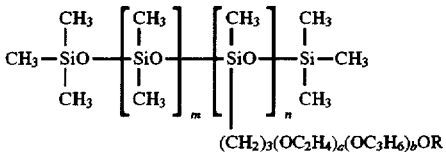

Y: $(CH_2)_3(OC_2H_4)_a(OC_3H_6)_bOR$
R: H or a lower alkyl group
m, n: integers of 2 or more
a, b: integers of 0 or more provided a and b are not 0 at the same time.

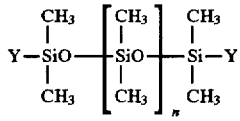

R: H or a lower alkyl group
n: integers of 1 or more
a, b: intgers of 0 or more provided a and b. are not 0 at the same time.

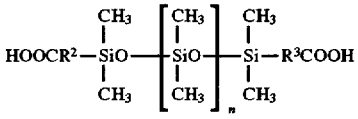

$R^2$, $R^3$: polyalkylene oxide or an alkyl group
n: integers of 1 or more

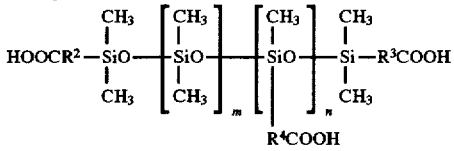

$R^2$, $R^3$, $R^4$: polyalkylene oxide or an alkyl group
m, n: integers of 1 or more Examples of the resin component for use in the thermosoftening ink for the formation of images to be peeled away from the image recording support material in the present invention are polystyrene, acrylic resin, methacrylic resin, styrene—butyl acrylate copolymer, styrene—butadiene copolymer, polyester, and epoxy resin.

Figure 3:
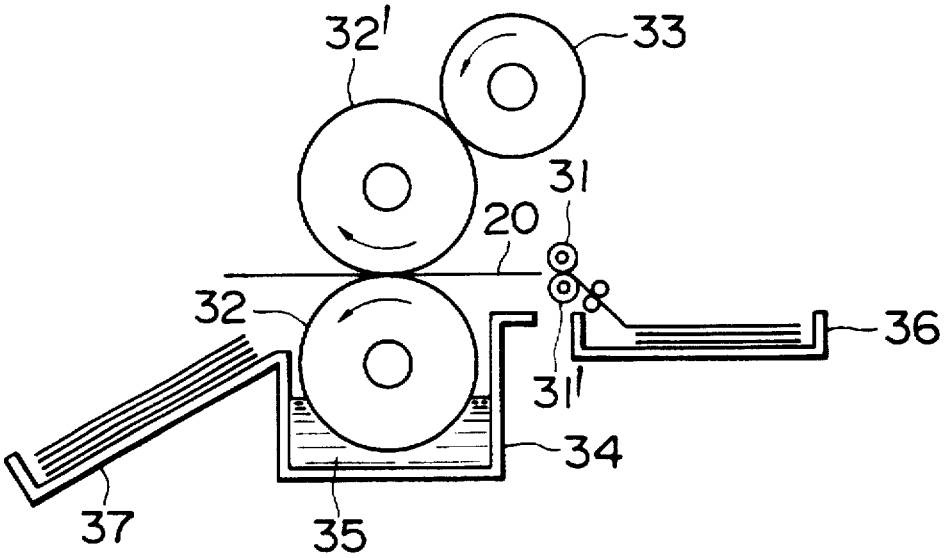
FIG. 3 in a cross-sectional view which shows one example of an apparatus for producing a recyclable image recording support material according to the present invention.

With reference to FIG. 3, an example of an apparatus for producing a recyclable image recording support material of the present invention will now be explained.

The apparatus for producing a recyclable image recording support material of the present invention is not limited to the apparatus shown in FIG. 3.

In FIG. 3, an image recording support material 20 which is to be converted into a recyclable image recording support material bears no toner images thereon. The image recording support material 20 is composed of a paper sheet on both sides of which toner images composed of a thermosoftening ink can be formed. To both sides of the image recording support material 20, an aqueous coating liquid 35 is applied in an effective trace amount, which is selected from the group consisting of a surfactant solution comprising a surfactant, an aqueous water-soluble polymer solution comprising a water-soluble polymer, and a mixture of the surfactant solution and the aqueous water-soluble polymer solution.

The image recording support material 20 is then allowed to stand at room temperature for several seconds. Since the amount of the applied aqueous coating liquid 35 is so small that it dries in several seconds at room temperature, without using any heat or pressure application means.

More specifically, a stack of the image recording materials 20 is placed in a paper tray 36.

Each of the image recording materials 20 is transported by a pair of transporting rollers 31 and 31' so as to pass between a pair of coating rollers 32 and 32'. The lower part of the coating roller 32 is dipped into the aqueous coating liquid 35 placed in a liquid container 34, so that as the coating roller 32 is rotated, the aqueous coating liquid 35 is carried onto the coating roller 32' to form a thin layer of the aqueous coating liquid 35. The thickness of the thin layer of the coating liquid 35 formed on the coating roller 32' is regulated by a doctor roller 33.

Thus, as the image recording material 20 is transported so as to pass between the coating rollers 32 and 32', the coating liquid 35 is coated in the form of an extremely thin layer on both sides of the image recording material 20.

The coated layer of the coating liquid 35 is so thin that it dries at room temperature in several seconds, without using any heat and/or pressure application means, whereby a recyclable image recording support material free from elongation, wrinkles, waving and curl can be produced in a dry state.

Figure 4:
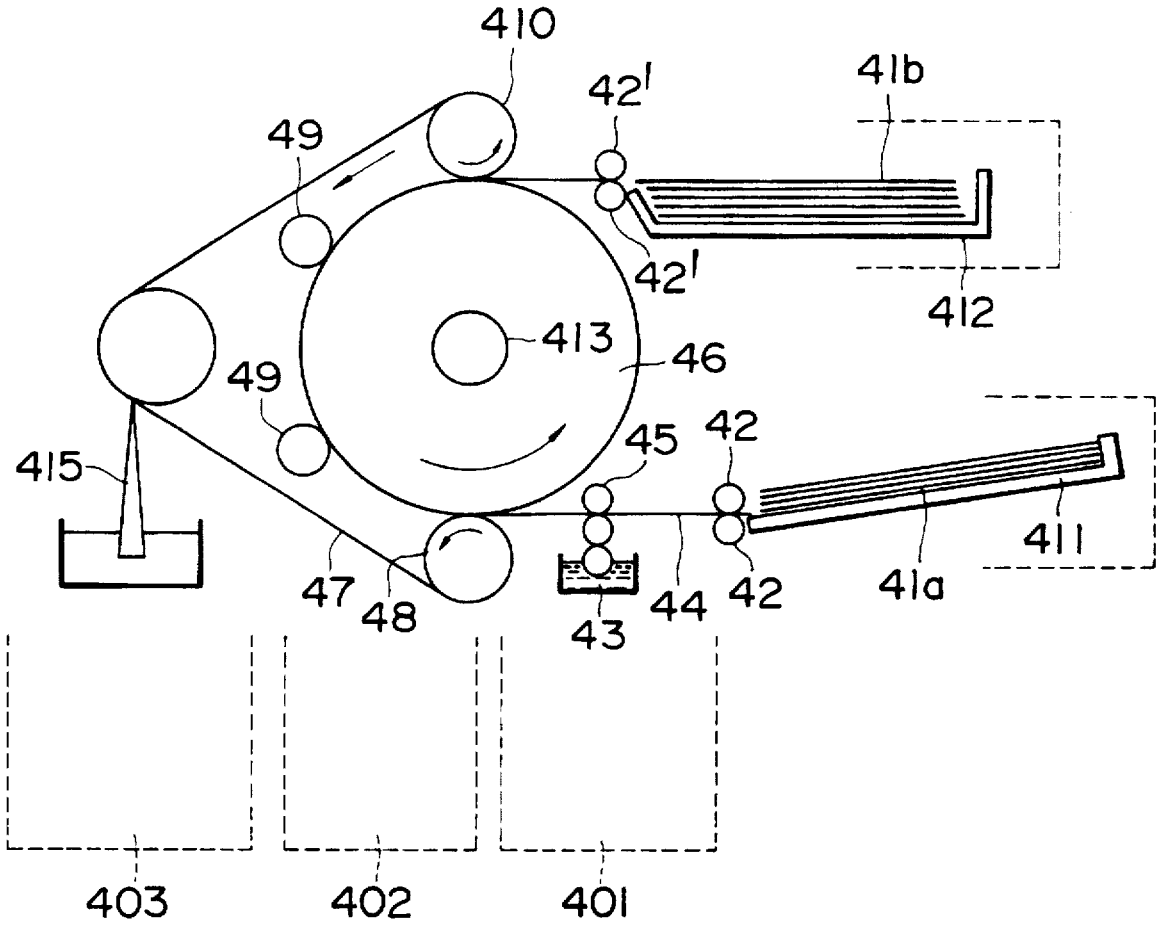
FIG. 4 is a cross-sectional view which shown another example of an apparatus for producing a recyclable image recording support material according to the present invention.

With reference to FIG. 4, a method of producing a recyclable image recording support material which comprises a paper layer by use of an image recording support material free from toner images thereon so as to convert the same into a recyclable image recording support material will now be explained according to the present invention.

A stack of image recording support materials 41*a* is placed in a lower paper tray 411.

The image recording support material 41*a* is transported by a pair of lower transporting rollers 42, 42 into a coating section 401 in which an aqueous coating liquid 43 selected from the group consisting of an aqueous surfactant solution comprising a surfactant, an aqueous water-soluble polymer solution comprising a water-soluble polymer, and a mixture of the aqueous surfactant solution and the aqueous water-soluble polymer solution is thinly applied to an image-bearable side 44 of the image recording support material 41*a* in such an amount that the amount of water applied to the image-bearable side of the image recording support material is in the range of 0.06 to 0.4 g per A4 size of the image recording support material 41*a* by a coating device 45.

The image recording support material 41*a*, with the coating liquid 43 applied thereto, is then transported into an image removing section 402.

The image removing section 402 is composed of a heat application roller 46 with a built-in inner heater 413, an image releasing belt 47, part of which is in close contact with part of the outer surface of the heat application roller 46, an introducing roller 48, a pair of pressure application rollers 49, and a discharging roller 410.

The image recording support material 41*a* is then transported by a pair of upper transporting rollers 42', 42' onto an upper paper tray 412, whereby a recyclable image recording support material 41*b* is obtained in a dry state in such a manner so as to be successively usable for copying or recording.

In the above method of producing the recyclable image recording support material, the aqueous coating liquid 43 in thinly applied to the image-bearable side 44 of the image recording support material 41*a* in such an amount that the amount of water applied to the image-bearable side of the image recording support material is in the range of 0.06 to 0.4 g per A4 size of the image recording support material 41*a*, so that the recyclable image recording support material 41*b* is dried at room temperature within several seconds and therefore obtained in such a manner so an to be successively usable for copying or recording as mentioned above.

In the above case, since the image recording support material 41*a* bears no images thereon, the coating liquid 43 is merely applied to the image-bearable side 44 of the image recording support material 41*a* and dried in the image removing section 402 under application of heat and pressure thereto by the heat application roller 46 and the image releasing belt 47, without removing any images therefrom.

However, if the image recording support material 41*a*bears images thereon, the aqueous coating liquid 43 is replaced by a water-containing image removal acceleration liquid, and the image recording support material 41*a* is set in such a manner that the image-bearing side 44 thereof comes into contact with the image releasing belt 47, and the images are transferred to the inner side of the image releasing belt 47 and therefore removed therefrom by the image releasing belt 47 in the image removing section 402.

The images transferred to the image releasing belt 47 are removed therefrom by a cleaning member 415 in a cleaning section 403.

Figure 5:
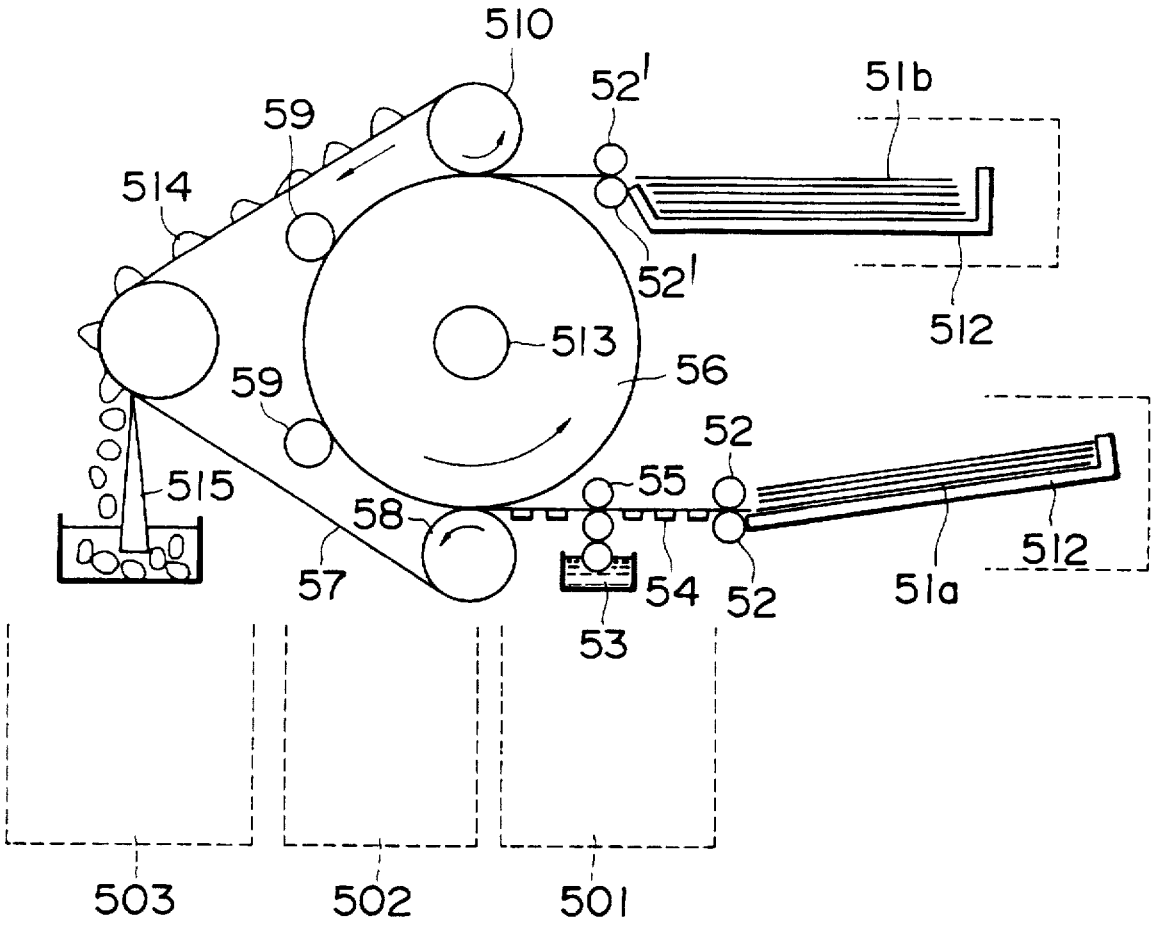
FIG. 5 is a cross-sectional view which shows another example of an apparatus for recycling a recyclable image recording support material according to the present invention.

With reference to FIG. 5, a method of recycling an image recording support material comprising a paper layer which is capable of copying or recording images thereon and bears images thereon will now be explained according to the present invention.

A stack of image recording support materials 51*a* is placed in a lower paper tray 511.

The image recording support material 51*a* bears images on an image-bearing side 54 and is transported by a pair of lower transporting rollers 52, 52 into a coating section 501 in which a water-containing image removal acceleration liquid 53 selected from the group consisting of (a) water, (b) an aqueous surfactant solution comprising a surfactant, (c) an aqueous water-soluble polymer solution comprising a water-soluble polymer, and (d) a mixture of the aqueous surfactant solution and the aqueous water-soluble polymer solution is thinly applied to the image-bearing side 54 of the image recording support material 51*a* in such an amount that the amount of water applied to the image-bearing side 54 of the image recording support material 51*a* is in the range of 0.08 to 0.4 g per A4 size of the image recording support material 51*a* by a coating device 55.

The image recording support material 51*a*, with the water-containing image removal acceleration liquid 53 applied thereto, is then transported into an image removing section 502.

The image removing section 502 is composed of a heat application roller 56 with a built-in inner heater 513, an image releasing belt 57, part of which is in close contact with part of the outer surface of the heat application roller 56, an introducing roller 59, a pair of pressure application rollers 59, and a discharging roller 510.

The image recording support material 51*a* is set in such a manner that the image-bearing side 54 thereof comes into close contact with the inner side of the image releasing belt 57, and the images are transferred to the image releasing belt 57 and therefore removed therefrom by the image releasing belt 57 in the image removing section 502.

The image recording support material 51*a* is then transported by a pair of upper transporting rollers 52', 52' onto an upper paper tray 512, whereby a recyclable image recording support material 51*b* is obtained in a dry state in such a manner so as to be successively usable for copying or recording.

In the above method of producing the recyclable image recording support material, the image removal acceleration liquid is thinly applied to the image-bearing side 54 of the image recording support material 51*a* in such an amount that the amount of water applied to the image-bearing side 54 of the image recording support material 51*a* is in the range of 0.08 to 0.4 g per A4 size of the image recording support material 51*a*, so that the recyclable image recording support material 51*b* is dried at room temperature within several seconds and therefore obtained in such a manner so as to be successively usable for copying or recording as mentioned above.

The images transferred to the image releasing belt 57 are composed of a thermosoftening ink 514 and removed therefrom by a cleaning member 515 in a cleaning section 503.

In the image removing section 502, image removing operation 18 carried out under the conditions that water is difficult to be evaporated therefrom, with the application of heat and pressure to the image bearing image recording support material 51*a*.

Other features of thin invention will become apparent in the course of the following description of exemplary embodiments, which are given for illustration of the invention and are not intended to be limiting thereof.

EXAMPLE 1

A commercially available surfactant (Trademark "BT-7" made by Nikko Chemicals Co., Ltd.) was applied to an image-bearable side of a sheet of PPC paper in such a fashion that the applied amount of the surfactant was 0.01 g per A4 size of the paper. Thus, a recyclable image recording support material capable of repeatedly copying and recording images thereon according to the present invention was prepared.

Then, toner images were formed on the surfactant-applied surface of the above prepared copy paper, using a commercially available copying machine for PPC paper (Trademark "IMAGIO 320 FF1", made by Ricoh Company, Ltd.).

Figure 2:
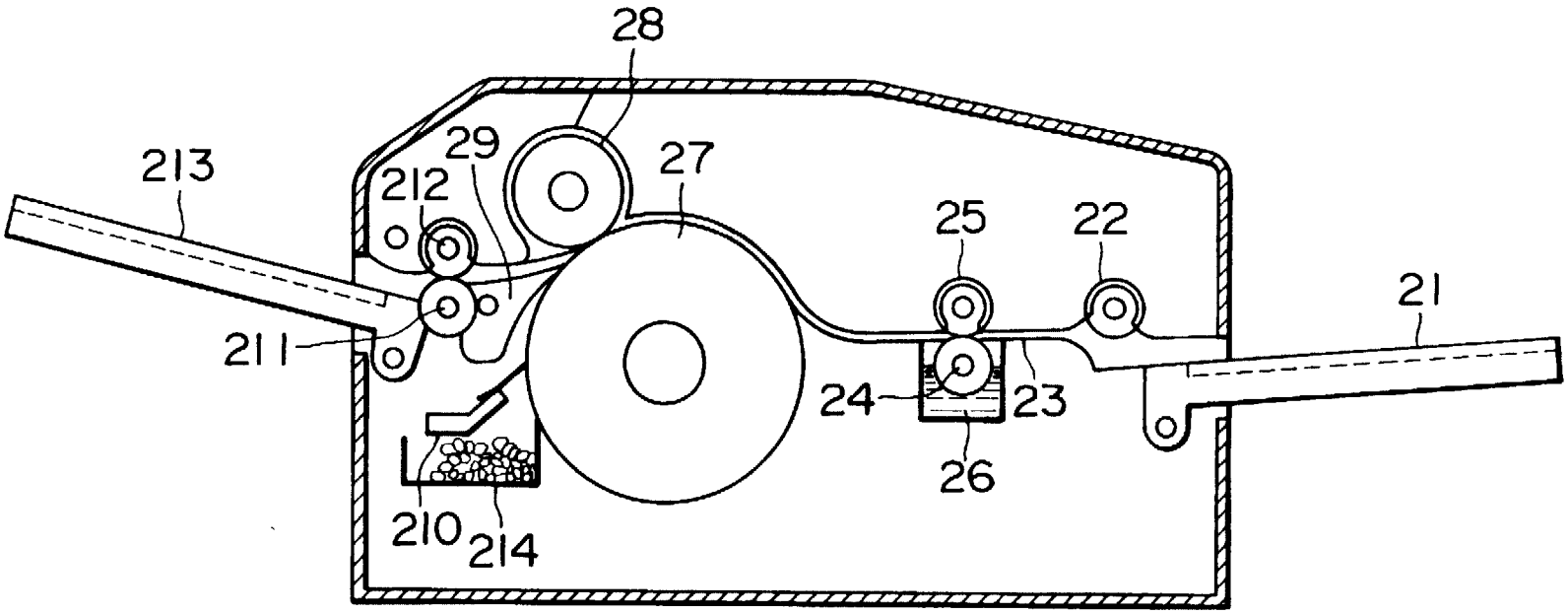
FIG. 2 is a cross-sectional view which shows one example of an apparatus for recycling a recyclable image recording support material according to the present invention.

The toner images were removed from the above-mentioned copy paper, using a recycling apparatus according to the present invention as shown in FIG. 2.

To be more specific, an aqueous solution of the commercially available surfactant (Trademark "BT-7" made by Nikko Chemicals Co., Ltd.) with a concentration of 1 wt. % was applied to the toner-image-deposited surface of the copy paper by a coating roller 24 in such a fashion that the applied amount of the aqueous solution was about 0.1 g per A4 size of paper. Then, the image-deposited surface of the copy paper was brought into contact with the surface of an image release roller 27, and caused to pass through a nip between the image release roller 27 and a heat-application roller 28 under the application of heat and pressure to the copy paper. After the copy paper was separated from the image release roller 27 by means of a separating claw 29, the hydrophobic toner images were removed from the copy paper. Finally, the copy paper was led to a paper-receiving tray 213 by transporting rollers 211 and 212.

In FIG. 2, reference numeral 21 indicates a paper tray; reference numeral 22, a paper-feeding roller; reference numeral 23, a guide plate; reference numeral 25, a transporting roller; reference numeral 26, an aqueous coating liquid; reference numeral 210, a toner cleaning member; and reference numeral 214, a container for collecting toner.

The thus obtained copy paper was free from wrinkles, waving, elongation, or curling. In addition, when the copy paper thus obtained by the recycling method of the present invention was again subjected to copying operation, using the above-mentioned copying machine, clear images were formed on the copy paper. This proved that when the copy paper was exhausted from the recycling apparatus, the copy paper was dry to such a degree that It was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

COMPARATIVE EXAMPLE 1

Toner images were formed on a sheet of fresh PPC paper, using a commercially available copying machine for PPC paper (Trademark "IMAGIO 320 FF1", made by Ricoh Company, Ltd.).

The same procedure for removal of toner images from the toner-image-deposited copy paper as that employed in Example I was repeated. Then, the image removal condition of the copy paper was visually observed. As a result, 50% or more of the image area remained on the copy paper.

EXAMPLE 2

A commercially available surfactant (Trademark "MA-80" made by Mitsui Cytec, Ltd.) was applied to an image-bearable side of a sheet of PPC paper in such a fashion that the applied amount of the surfactant was 0.1 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper was exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 3

A commercially available surfactant (Trademark "AOT" made by Mitsui Cytec, Ltd.) was applied to an image-bearable side of a sheet of PPC paper in such a fashion that the applied amount of the surfactant was 0.1 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper was exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 4

A commercially available surfactant (Trademark "BT-12" made by Nikko Chemicals Co., Ltd.) was applied to an image-bearable side of a sheet of PPC paper in such a fashion that the applied amount of the surfactant was 0.02 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper was exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 5

A commercially available surfactant (Trademark "S-113" made by Asahi Glass Co., Ltd.) was applied to an image-bearable side of a sheet of PPC paper in such a fashion that the applied amount of the surfactant was 0.2 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper was exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 6

A commercially available surfactant (Trademark "S-145" made by Asahi Glass Co., Ltd.) was applied to an image-bearable side of a sheet of FPC paper in such a fashion that the applied amount of the surfactant was 0.2 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper was exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 7

A commercially available surfactant (Trademark "S-111" made by Asahi Glass Co., Ltd.) was applied to an image-bearable side of a sheet of PPC paper in such a fashion that the applied amount of the surfactant was 0.2 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper was exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 8

A mixture of a commercially available surfactant (Trademark "S-113" made by Asahi Glass Co., Ltd.) and a commercially available surfactant (Trademark "MA-80" made by Mitsui Cytec, Ltd.) with a mixing ratio by weight of 1:8 was applied to an image-bearable side of a sheet of PPC paper in such a fashion that the applied amount of the surfactants was 0.1 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper wan exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 9

A mixture of a commercially available surfactant (Trademark "S-113" made by Asahi Glass Co., Ltd.) and a commercially available surfactant (Trademark "AOT" made by Mitsui Cytec, Ltd.) with a mixing ratio by weight of 1:0.05 was applied to an image-bearable side of a sheet of PPC paper in such a fashion that the applied amount of the surfactants was 0.1 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper was exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 10

A mixture of a commercially available surfactant (Trademark "S-113" made by Asahi Glass Co., Ltd.) and a commercially available surfactant (Trademark "S-145" made by Asahi Glaze Co., Ltd.) with a mixing ratio by weight of 1:0.7 was applied to an image-bearing side of a sheet of PPC paper in such a fashion that the applied amount of the surfactants was 0.2 g per A4 size of the paper. Thus, a recyclable image recording support material capable of copying and recording images thereon according to the present invention was prepared.

Then, toner images were formed on the above prepared copy paper, and removed therefrom by the same method as in Example 1.

The thus obtained copy paper was free from wrinkles, waving, elongation or curling. In addition, when the copy paper thus obtained by the recycling method of the present invention was again subjected to copying operation, clear images were formed on the copy paper. This proved that when the copy paper was exhausted from the recycling apparatus, the copy paper was dry to such a degree that it was ready for the next copying operation.

Such an image formation and removal was repeated 10 times using the above-mentioned copy paper. As a result, the image quality of the toner images finally obtained on the copy paper was the same as that of toner images initially formed on a fresh copy paper.

EXAMPLE 11

Using an apparatus for producing a recyclable image recording support material, as shown in FIG. 3, a sheet of commercially available PPC paper (Trademark "T6200", made by Ricoh Company, Ltd.) was surface-treated by an aqueous solution of a commercially available surfactant (Trademark "S-113", made by Asahi Glass Co., Ltd.) to obtain a recyclable image recording support material according to the present invention.

To be more specific, the fresh copy paper set on a paper tray 36 was transported by transporting rollers 31 and 31', and caused to pass through a nip between a pair of coating rollers 32 and 32' at a linear speed of 100 mm/sec. The aqueous solution of the commercially available surfactant (Trademark "S-113", made by Asahi Glass Co., Ltd.) 35 with a concentration of 30 wt. % stored in a liquid container 34 was applied to both sides of the fresh copy paper in such a fashion that the applied amount was regulated to 0.2 to 0.3 g per A4 size of paper by the action of a doctor roller 33. Then, the copy paper thus treated with the aqueous solution of the surfactant was exhausted to a paper-receiving tray 37. Thus, a recyclable image recording support material capable of repeatedly copying and recording images thereon according to the present invention was obtained by allowing it to stand at room temperature for several tens of seconds. Such a recyclable image recording support material was free from curling, elongation, wrinkles or waving.

Thereafter, toner images were formed on the recyclable copy paper thus obtained, using a commercially available copying machine for PPC paper (Trademark "IMAGIO 320 FP1", made by Ricoh Company, Ltd.). As a result, the image quality of the obtained copied images was the same as that of the images formed on a fresh copy paper.

The toner images were removed from the above-mentioned copy paper, using a recycling apparatus according to the present invention as shown in FIG. 2.

To be more specific, an aqueous solution of the commercially available surfactant (Trademark "BT-7" made by Nikko Chemicals Co., Ltd.) with a concentration of 1 wt. % was applied to the toner-image-deposited surface of the copy paper by a coating roller 24 in such a fashion that the applied amount of the aqueous solution was about 0.1 g per A4 size of paper. Then, the image-deposited surface of the copy paper was brought into contact with the surface of an image release roller, 27, and caused to pass through a nip between the image release roller 27 and a heat-application roller 28 under the application of heat and pressure to the copy paper. After the copy paper was separated from the image release roller 27 by means of a separating claw 29, the hydrophobic toner images were removed from the copy paper. Finally, the copy paper was led to a paper-receiving tray 213 by transporting rollers 211 and 212.

The thus obtained copy paper was free from curling, elongation, wrinkles or waving. In addition, the images were completely removed from the copy paper and the copy paper was dry to such a degree that it was ready for the next copying operation.

The copy paper thus obtained by the recycling method of the present invention was again subjected to copying operation, using the above-mentioned copying machine, clear images were formed on the copy paper.

COMPARATIVE EXAMPLE 2

Toner images were formed on a sheet of fresh PPC paper (Trademark "T6200", made by Ricoh Company, Ltd.), using a commercially available copying machine for PPC paper (Trademark "IMAGIO 320 FP1", made by Ricoh Company, Ltd.).

The procedure for removal of toner images from the toner-image-deposited copy paper in Example 11 was repeated. When the image removal condition of the copy paper was visually observed, 50% or more of the image area remained on the copy paper.

EXAMPLE 12

The procedure for surface treatment of the fresh PPC paper for obtaining a recyclable copy paper in Example 11 was repeated except that the aqueous solution of the commercially available surfactant (Trademark "S-113" made by Asahi Glass Co., Ltd.) was replaced by a commercially available surfactant (Trademark "S-145" made by Asahi Glass Co., Ltd.). Thus, a recyclable image recording support material according to the present invention was prepared.

The thus obtained recyclable copy paper was free from curling, elongation, wrinkles or waving. In addition, the recyclable copy paper was dry to such a degree that it was ready for the next copying operation.

Then, toner images were formed on the thus prepared recyclable copy paper by the same method as in Example 11. As a result, clear images were formed on the recyclable copy paper.

EXAMPLE 13

The procedure for surface treatment of the fresh PPC paper for obtaining a recyclable copy paper in Example 11 was repeated except that the aqueous solution of the commercially available surfactant (Trademark "S-113" made by Asahi Glass Co., Ltd.) was replaced by a commercially available surfactant (Trademark "S-145" made by Asahi Glass Co., Ltd.). Thus, a recyclable image recording support material according to the present invention was prepared.

The thus obtained recyclable copy paper was free from curling, elongation, wrinkles or waving. In addition, the recyclable copy paper was dry to such a degree that it was ready for the next copying operation.

Then, toner images were formed on the thus prepared, recyclable copy paper by the same method as in Example 11. As a result, clear images were formed on the recyclable copy paper.

EXAMPLE 14

The procedure for surface treatment of the fresh PPC paper for obtaining a recyclable copy paper in Example 11 was repeated except that the aqueous solution of the commercially available surfactant (Trademark "S-113" made by Asahi Glass Co., Ltd.) was replaced by a commercially available surfactant (Trademark "MA-80" made by Mitsui Cytec, Ltd.). Thus, a recyclable image recording support material according to the present invention was prepared.

The thus obtained recyclable copy paper was free from curling, elongation, wrinkles or waving. In addition, the recyclable copy paper was dry to such a degree that it was ready for the next copying operation.

Then, toner images were formed on the thus prepared recyclable copy paper by the same method as in Example 11. As a result, clear images were formed on the recyclable copy paper.

EXAMPLE 15

The procedure for surface treatment of the fresh PPC paper for obtaining a recyclable copy paper in Example 11 was repeated except that the aqueous solution of the commercially available surfactant (Trademark "S-113" made by Asahi Glass Co., Ltd.) was replaced by a commercially available surfactant (Trademark "AOT" made by Mitsui Cytec, Ltd.). Thus, a recyclable image recording support material according to the present invention was prepared.

The thus obtained recyclable copy paper was free from curling, elongation, wrinkles or waving. In addition, the recyclable copy paper was dry to such a degree that it was ready for the next copying operation.

Then, toner images were formed on the thus prepared recyclable copy paper by the same method as in Example 11. As a result, clear images were formed on the recyclable copy paper.

EXAMPLE 16

The procedure for surface treatment of the fresh PPC paper for obtaining a recyclable copy paper in Example 11 was repeated except that the aqueous solution of the commercially available surfactant (Trademark "S-113" made by Asahi Glass Co., Ltd.) was replaced by a mixture of the commercially available surfactant (Trademark "S-113" made by Asahi Glass Co., Ltd.) and the commercially available surfactant (Trademark "S-145" made by Asahi Glass Co., Ltd.) with a mixing ratio by weight of 1:0.7. Thus, a recyclable image recording support material according to the present invention was prepared.

The thus obtained recyclable copy paper was free from curling, elongation, wrinkles, or waving. In addition, the recyclable copy paper was dry to such a degree that it was ready for the next copying operation.

Then, toner images were formed on the thus prepared recyclable copy paper by the same method as in Example 11. As a result, clear images were formed on the recyclable copy paper.

EXAMPLE 17

The procedure for surface treatment of the fresh PPC paper for obtaining a recyclable copy paper in Example 11 was repeated except that the aqueous solution of the commercially available surfactant (Trademark "S-113" made by Asahi Glass Co., Ltd.) was replaced by a mixture of the commercially available surfactant (Trademark "S-113" made by Asahi Glass Co., Ltd.) and the commercially available surfactant (Trademark "S-111" made by Asahi Glass Co., Ltd.) with a mixing ratio by weight of 1:1.5. Thus, a recyclable image recording support material according to the present invention was prepared.

The thus obtained recyclable copy paper was free from curling, elongation, wrinkles or waving. In addition, the recyclable copy paper was dry to such a degree that it was ready for the next copying operation.

Then, toner images were formed on the thus prepared recyclable copy paper by the same method as in Example 11. As a result, clear images were formed on the recyclable copy paper.

EXAMPLE 18

The procedure for surface treatment of the fresh PPC paper for obtaining a recyclable copy paper in Example 11 was repeated except that the aqueous solution of the commercially available surfactant (Trademark "S-113" made by Asahi Glass Co., Ltd.) was replaced by a mixture of the commercially available surfactant (Trademark "S-113" made by Asahi Glass Co., Ltd.) and the commercially available surfactant (Trademark "MA-80" made by Mitsui Cytec, Ltd.) with a mixing ratio by weight of 1:8. Thus, a recyclable image recording support material according to the present invention was prepared.

The thus obtained recyclable copy paper was free from curling, elongation, wrinkles or waving. In addition, the recyclable copy paper was dry to such a degree that it was ready for the next copying operation.

Then, toner images were formed on the thus prepared recyclable copy paper by the same method as in Example 11. As a result, clear images were formed on the recyclable copy paper.

EXAMPLE 19

The procedure for surface treatment of the fresh PPC paper for obtaining a recyclable copy paper in Example 11 was repeated except that the aqueous solution of the commercially available surfactant (Trademark "S-113" made by Asahi Glass Co., Ltd.) was replaced by a mixture of the commercially available surfactant (Trademark "S-145" made by Asahi Glass Co., Ltd.) and the commercially available surfactant (Trademark "AOT" made by Mitsui Cytec, Ltd.) with a mixing ratio by weight of 1:0.05 Thus, a recyclable image recording support material according to the present invention was prepared.

The thus obtained recyclable copy paper was free from curling, elongation, wrinkles, or waving. In addition, the recyclable copy paper was dry to such a degree that it was ready for the next copying operation.

Then, toner images were formed on the thus prepared recyclable copy paper by the same method as in Example 11. As a result, clear images were formed on the recyclable copy paper.

EXAMPLE 20

Using an apparatus for producing a recyclable image recording support material, as shown in FIG. 4, a sheet of commercially available PPC paper (Trademark "T6200", made by Ricoh Company, Ltd.) was surface-treated by an aqueous solution of the commercially available surfactant (Trademark "S-113", made by Asahi Glass Co., Ltd.) to obtain a recyclable image recording support material according to the present invention.

To be more specific, the fresh copy paper was caused to pass-through a coating roller at a linear speed of 100 mm/sec by a transporting roller. At that time, the aqueous solution of the commercially available surfactant (Trademark "S-113", made by Asahi Glass Co., Ltd.) 43 with a concentration of 1 wt. % stored in a liquid container was uniformly applied to an image-bearable side of the fresh copy paper in an applied amount of 0.2 to 0.3 g per A4 size of paper. Then, while the surface-treated copy paper was caused to pass along the periphery of a heat-application roller 46 under the application of pressure thereto, the surface-treated copy paper was heated and dried. Then the surface-treated copy paper was exhausted from the apparatus of FIG. 4. Thus, a recyclable image recording support material capable of repeatedly copying and recording images thereon according to the present invention was obtained by allowing it to stand at room temperature for several seconds. Such a recyclable image recording support material was free from curling, elongation, wrinkles or waving.

Thereafter, toner images were formed on the thus obtained recyclable copy paper, using a commercially available copying machine for PPC paper (Trademark "IMAGIO 320 FP1", made by Ricoh Company, Ltd.). As a result, the image quality of the obtained copied images was the same as that of the images formed on a fresh copy paper.

The toner images were removed from the above-mentioned copy paper, using a recycling apparatus according to the present invention as shown in FIG. 5.

To be more specific, the toner-image-deposited copy paper was transported and caused to pass through a coating roller at a linear speed of 100 mm/sec by a pair of transporting rollers 52, so that an aqueous solution of the commercially available surfactant (Trademark "S-113" made by Asahi Glass Co., Ltd.) 53 with a concentration of 1 wt. % was uniformly applied to the toner-image-deposited surface of the copy paper in such a fashion that the applied amount of the aqueous solution was 0.2 to 0.3 g per A4 size of paper.

Then, the image-deposited surface of the copy paper was caused to pass through a nip between a heat-application roller 56 and an introducing roller 58 under the application of heat and pressure. The toner images deposited on the copy paper were removed from the copy paper and transferred to an image releasing belt 57.

The image-free copy paper became dry to such a degree that it was ready for the next copying operation by allowing it to stand at room temperature for several seconds.

The copy paper thus obtained by the recycling method of the present invention was again subjected to copying operation, using the above-mentioned copying machine, clear images were formed on the copy paper.

COMPARATIVE EXAMPLE 3

Toner images were formed on a sheet of fresh PPC paper (Trademark "T6200", made by Ricoh Company, Ltd.), using a commercially available copying machine for PPC paper (Trademark "IMAGIO 320 FP1", made by Ricoh Company, Ltd.).

The same procedure for removal of toner images from the toner-image-deposited copy paper as that employed in Example 20 was repeated. As a result, it was confirmed by visual observation that 50% or more of the image area remained on the copy paper.

Thereafter, the copy paper having residual toner images thereon was repeatedly subjected to the image removal operation using the apparatus as shown in FIG. 5. It was not till at the second image removal operation that the residual toner images were completely removed from the copy paper.

As previously explained, since the amount of the aqueous coating liquid to be applied to the image recording support material is extremely small when a recyclable image recording support material is produced, the image recording support material wetted with the aqueous coating liquid can be usually dried by allowing it to stand at room temperature for several seconds, without requiring any particular additional drying means.

Similarly, when the toner images are formed on the image recording support material, the toner images are removed therefrom by the application of a small amount of the image removal acceleration liquid according to the present invention. Therefore, the recycled image recording support material is free from the problems of elongation, wrinkles, waving, or curling.

As a result, according to the present invention, the power consumption required by the recycling apparatus of the present invention can be decreased, and the size of the apparatus can be reduced, thereby drastically decreasing the cost for recycling the image recording support material.

What is claimed is:

1. A method of producing a recyclable image recording support material comprising a paper layer capable of copying or recording images thereon, comprising the step of:

applying to an image-bearable side of an image recording support material comprising a paper layer free from images thereon an aqueous coating liquid selected from the group consisting of an aqueous surfactant solution comprising a surfactant with a concentration in the range of 0.1 wt. % or more, an aqueous water-soluble polymer solution comprising a water-soluble polymer with a concentration of 0.1 to 60 wt. %, and a mixture of said aqueous surfactant solution and said aqueous water-soluble polymer solution, in an effective trace amount.

2. The method of producing a recyclable image recording support material as claimed in claim 1, wherein said aqueous coating liquid is applied to said image recording support material in such an amount that the amount of water applied to said image-bearable side of said image recording support material is in the range of 0.06 to 0.4 g per A4 size of said image recording support material.

3. The method of producing a recyclable image recording support material as claimed in claim 1, wherein said aqueous coating liquid is applied to said image recording support material in such an amount that the amount of said surfactant applied to said image-bearable side of said image recording support material is in the range of 0.01 to 0.4 g per A4 size of said image recording support material.

4. The method of producing a recyclable image recording support material as claimed in claim 1, wherein said aqueous coating liquid is applied to said image recording support material in such an amount that the amount of said water-soluble polymer applied to said image-bearable side of said image recording support material is in the range of 0.01 to 1 g per A4 size of said image recording support material.

5. The method of producing a recyclable image recording support material as claimed in claim 1, wherein said aqueous water-soluble polymer solution comprises said water-soluble polymer with a concentration of 0.5 to 10 wt. %.

6. The method of producing a recyclable image recording support material as claimed in claim 5, wherein said water-soluble polymer is selected from the group consisting of natural polymers, semi-synthetic polymers and synthetic polymers.

7. The method of producing a recyclable image recording support material as claimed in claim 6, wherein said natural polymers are selected from the group consisting of starch, mannan, seaweed-based polymers, plant mucilage, micro-organism mucilage and protein.

8. The method of producing a recyclable image recording support material as claimed in claim 6, wherein said semi-synthetic polymers are selected from the group consisting of viscose, methyl cellulose, ethyl cellulose, hydroxyethyl cellulose, carboxymethyl cellulose, soluble starch, carboxymethyl starch and dialdehyde starch.

9. The method of producing a recyclable image recording support material as claimed in claim 6, wherein said synthetic polymers are selected from the group consisting of polyvinyl alcohol, sodium polyacrylate, polyethylene oxide and isobutylene-maleic anhydride copolymer.

10. An apparatus for producing a recyclable image recording support material comprising a paper layer capable of copying or recording images thereon, comprising:

aqueous coating liquid application means for applying to an image-bearable side of an image recording support material free from images thereon an aqueous coating liquid selected from the group consisting of an aqueous surfactant solution comprising a surfactant with a concentration in the range of 0.1 wt. % or more, an aqueous water-soluble polymer solution comprising a water-soluble polymer with a concentration of 0.1 to 60 wt. %, and a mixture of said aqueous surfactant solution and said aqueous water-soluble polymer solution, in an effective trace amount.

11. A recycling apparatus for recycling an image recording support material which is capable of copying or recording images one or both sides thereof, free from images formed thereon, comprising:

water-containing image removal acceleration liquid application means for applying to an image-bearing side of said image recording support material a water-containing image removal acceleration liquid selected from the group consisting of (a) water, (b) an aqueous surfactant solution comprising a surfactant, (c) an aqueous water-soluble polymer solution comprising a water-soluble polymer, and (d) an aqueous surfactant and water-soluble polymer solution comprising a surfactant and a water-soluble polymer in such an amount that the amount of water applied to said image-bearing side of said image recording support material is in the range of 0.08 to 0.4 g per A4 size of said image recording support material.

12. A method of producing a recyclable image recording support material comprising a paper layer capable of copying or recording images thereon, comprising the steps of:

applying to an image-bearable side of an image recording support material comprising a paper layer an aqueous coating liquid selected from the group consisting of an aqueous surfactant solution comprising a surfactant with a concentration in the range of 0.1 wt. % or more, and an aqueous water-soluble polymer solution comprising a water-soluble polymer with a concentration of 0.1 to 60 wt. %, and a mixture of said aqueous surfactant solution and said aqueous water-soluble polymer solution, in an effective trace amount;

removing images, if any, from said image-bearable side of said image recording support material by bringing image releasing means into contact with said image-bearable side of said image recording support material under application of heat and pressure thereto; and drying said image recording support material.

13. The method of producing a recyclable image recording support material as claimed in claim 12, wherein said image recording support material coated with said aqueous coating liquid is dried by said image releasing means which is brought into contact with said image recording support material.

14. The method of producing a recyclable image recording support material as claimed in claim 12, wherein said aqueous coating liquid is applied to said image recording support material in such an amount that the amount of water applied to said image-bearable side of said image recording support material is in the range of 0.06 to 0.4 g per A4 size of said image recording support material.

15. The method of producing & recyclable image recording support material as claimed in claim 12, wherein said aqueous coating liquid is applied to said image recording support material in such an amount that the amount of said surfactant applied to said image-bearable side of said image recording support material is in the range of 0.01 to 0.4 g per A4 size of said image recording support material.

16. The method of producing a recyclable image recording support material an claimed in claim 12, wherein said aqueous coating liquid is applied to said image recording support material in such an amount that the amount of said water-soluble polymer applied to said image-bearable side of said image recording support material is in the range of 0.01 to 1 g per A4 size of said image recording support material.

17. The method of producing a recyclable image recording support material as claimed in claim 12, wherein said aqueous water-soluble polymer solution comprises said water-soluble polymer with a concentration of 0.5 to 10 wt. %.

18. The method of producing a recyclable image recording support material as claimed in claim 17, wherein said water-soluble polymer is selected from the group consisting of natural polymers, semi-synthetic polymers and synthetic polymers.

19. The method of producing a recyclable image recording support material as claimed in claim 18, wherein said natural polymers are selected from the group consisting of starch, mannan, seaweed-based polymers, plant mucilage, microorganism mucilage and protein.

20. The method of producing a recyclable image recording support material as claimed in claim 18, wherein said semi-synthetic polymers are selected from the group consisting of viscose, methyl cellulose, ethyl cellulose, hydroxyethyl cellulose, carboxymethyl cellulose, soluble starch, carboxymethyl starch and dialdehyde starch.

21. The method of producing a recyclable image recording support material as claimed in claim 18, wherein said synthetic polymers are selected from the group consisting of polyvinyl alcohol, sodium polyacrylate, polyethylene oxide and isobutylene-maleic anhydride copolymer.

22. A method of recycling an image recording support material comprising a paper layer which is capable of copying or recording images on one or both sides thereof and bears images thereon, comprising the steps of:

applying to an image-bearing side of said image recording support material an image removal acceleration liquid selected from the group consisting of (a) water, (b) an aqueous surfactant solution comprising a surfactant, (c) an aqueous water-soluble polymer solution comprising a water-soluble polymer, and (d) an aqueous surfactant and water-soluble polymer solution comprising a surfactant and a water-soluble polymer;

bringing image releasing means into contact with said image removal acceleration liquid applied image-bearing aide of said image recording support material under application of heat and pressure thereto, while said image bearing side of said image recording support material is wetted with said image removal acceleration liquid, thereby removing images from said image recording support material by said image releasing means; and drying said image recording support material by said image releasing means simultaneously with the removement of said images, thereby recycling said image recording support material in such a manner so as to be successively usable for copying or recording.

23. The method of recycling the image recording support material as claimed in claim 22, wherein said image removal acceleration liquid is applied to said image recording support material in such an amount that the amount of water applied to said image bearing side of said image recording support material is in the range of 0.08 to 0.4 g per A4 size of said image recording support material.

24. The method of recycling the image recording support material as claimed in claim 22, wherein said aqueous image removal acceleration liquid is applied to said image recording support material in such an amount that the amount of said surfactant applied to said image bearing side of said image recording support material is in the range of 0.06 to 0.4 g per A4 size of said image recording support material.

25. The method of recycling the image recording support material as claimed in claim 22, wherein said aqueous image removal acceleration liquid is applied to said image recording support material in such an amount that the amount of said water-soluble polymer applied to said image bearing side of said image recording support material is in the range of 0.01 to 0.4 g per A4 size of said image recording support material.

26. The method of recycling the image recording support material as claimed in claim 22, wherein said aqueous surfactant solution comprises a surfactant with a concentration of 0.01 to 20 wt. %.

27. The method of recycling the image recording support material as claimed in claim 22, wherein said aqueous water-soluble polymer solution comprises a water-soluble polymer with a concentration of 0.01 to 20 wt. %.

28. The method of recycling the image support material as claimed in claim 27, wherein said aqueous water-soluble polymer solution comprises said water-soluble polymer with a concentration of 0.5 to 10 wt. %.

29. The method of recycling the image support material as claimed in claim 28, wherein said water-soluble polymer is selected from the group consisting of natural polymers, semi-synthetic polymers and synthetic polymers.

30. The method of recycling the image recording support material as claimed in claim 29, wherein said natural polymers are selected from the group consisting of starch, mannan, seaweed-based polymers, plant mucilage, microorganism mucilage and protein.

31. The method of recycling the image recording support material as claimed in claim 29, wherein said semi-synthetic polymers are selected from the group consisting of viscose, methyl cellulose, ethyl cellulose, hydroxyethyl cellulose, carboxymethyl cellulose, soluble starch, carboxymethyl starch and dialdehyde starch.

32. The method of recycling the image recording support material as claimed in claim 29, wherein said synthetic polymers are selected form the groups consisting of polyvinyl alcohol, sodium polyacrylate, polyethylene oxide and isobutylene-maleic anhydride copolymer.

33. A recycling apparatus for recycling an image recording support material which is capable of copying or recording images one or both sides thereof and which bears image thereon, comprising:

water-containing image removal acceleration liquid application means for applying to the image-bearing side of said image recording support material a water-containing image removal acceleration liquid in such an amount that the amount of water applied to said image-bearing side of said image recording support material is in the range of 0.09 to 0.4 g per A4 size of said image recording support material; and image releasing and drying means for removing images from said image-bearing side of said image recording support material, with said image releasing means being brought into contact with said image-bearing side of said image recording support material under application of heat and pressure, while said image-bearing side of said image recording support material is wetted with said image removal acceleration liquid, thereby removing said images from said image recording support material, and for drying said image recording support material, thereby recycling said image recording support material in such a manner so an to be successively usable for copying or recording.

34. The recycling apparatus as claimed in claim 33, further comprising a copying or recording means for copying or recording images on said recycled image recording support material.

35. An apparatus for producing a recyclable image recording support material comprising a paper layer capable of copying or recording image, thereon, comprising:

aqueous coating liquid application means for applying to an image-bearable side of an image recording support material an aqueous coating liquid selected from the group consisting of an aqueous surfactant solution comprising a surfactant with a concentration in the range of 0.1 wt. % or more, and an aqueous water-soluble polymer solution comprising a water-soluble polymer with a concentration of 0.1 to 60 wt. %, and a mixture of said aqueous surfactant solution and said aqueous water-soluble polymer solution, in an effective trace amount; and image releasing and drying means for removing images, if any, from said image-bearable side of said image recording support material, with said image releasing means being brought into contact with said image-bearable side of said image recording support material under application of heat and pressure, while said image-bearable side is wetted with said aqueous coating liquid, thereby removing said images, if any, from said image-bearable side of said image recording support material, and for drying said image recording support material, thereby producing a recyclable image recording support material which is successively unable for copying or recording.

* * * * *

UNITED STATES PATENT AND TRADEMARK OFFICE

CERTIFICATE OF CORRECTION

PATENT NO. : 5,782,254

DATED : JULY 21, 1998

INVENTOR(S): Kiyoshi TANIKAWA, et al.

It is certified that an error appears in the above-identified patent and that said Letters Patent is hereby corrected as shown below:

Abstract, line 5 from the bottom "recyling" should read --recycling--.

Column 1, line 28, "an only method of " should read --the only method of--.

Column 2, line 26, "stop" should read --step--.

Column 7, line 46, "does not - bear images" should read --does not bear images--.

Column 10, line 42, "an the" should read --as the--.

Column 15, line 37, "eater" should read --ester--.

UNITED STATES PATENT AND TRADEMARK OFFICE

CERTIFICATE OF CORRECTION

PATENT NO. : 5,782,254

DATED : JULY 21, 1998

INVENTOR(S): Kiyoshi TANIKAWA, et al.

It is certified that an error appears in the above-identified patent and that said Letters Patent is hereby corrected as shown below:

Column 16, table 4, "

TABLE 4

| General Formula |
|---|
| 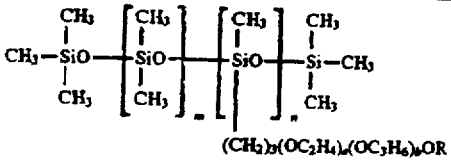 |
| Y: $(CH_2)_3(OC_2H_4)_a(OC_3H_6)_bOR$<br>R: H or a lower alkyl group<br>m, n: integers of 2 or more<br>a, b: integers of 0 or more provided a and b are not 0 at the same time. |
| 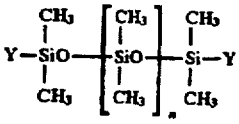 |
| R: H or a lower alkyl group<br>n: integers of 1 or more<br>a, b: intgers of 0 or more provided a and b. are not 0 at the same time. |
| 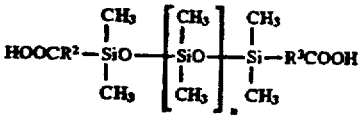 |
| $R^2$, $R^3$: polyalkylene oxide or an alkyl group<br>n: integers of 1 or more |
| 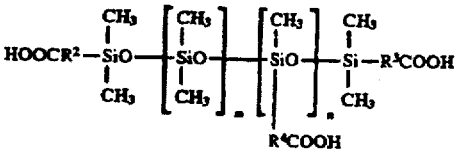 |
| $R^2$, $R^3$, $R^4$: polyalkylene oxide or an alkyl group<br>m, n: integers of 1 or more |

"

UNITED STATES PATENT AND TRADEMARK OFFICE

CERTIFICATE OF CORRECTION

PATENT NO. : 5,782,254

DATED : JULY 21, 1998

INVENTOR(S): Kiyoshi TANIKAWA, et al.

It is certified that an error appears in the above-identified patent and that said Letters Patent is hereby corrected as shown below:

Should read -- TABLE 4 --.

General Formula

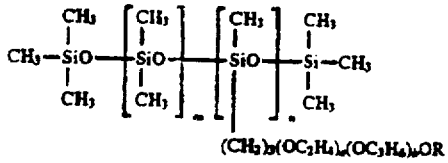

R: H or a lower alkyl group
m, n: integers of 2 or more
a, b: integers of 0 or more provided a and b are not 0 at the same time.

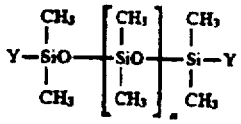

Y: $(CH_2)_3(OC_2H_4)_a(OC_3H_6)_bOR$
R: H or a lower alkyl group
n: integers of 1 or more
a, b: integers of 0 or more provided a and b. are not 0 at the same time.

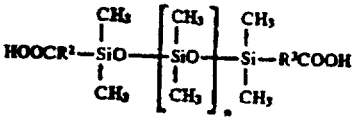

$R^2$, $R^3$: polyalkylene oxide or an alkyl group
n: integers of 1 or more

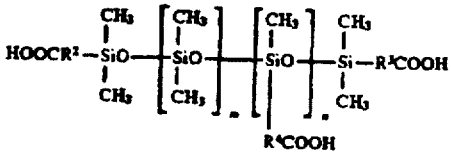

$R^2$, $R^3$, $R^4$: polyalkylene oxide or an alkyl group
m, n: integers of 1 or more

UNITED STATES PATENT AND TRADEMARK OFFICE

CERTIFICATE OF CORRECTION

PATENT NO. : 5,782,254

DATED : JULY 21, 1998

INVENTOR(S): Kiyoshi TANIKAWA, et al.

It is certified that an error appears in the above-identified patent and that said Letters Patent is hereby corrected as shown below:

Column 20, line 21, "FFI" should read --FPI--.

Column 23, line 44, "Asahi Glaze" should read --Asahi Glass--.

Column 25, line 34, "S-145" should read --S-111--.

Column 27, line 47, "pass-through" should read --pass through--.

Column 30, line 59, "producing & recyclable" should read --producing a recyclable--.

Column 31, line 47, "aide" should read --side--.

Column 32, line 49, "image" should read --images--.
Column 32, line 56, ".09" should read --.08--.

Column 33, line 10, "image," should read --images--.

Column 34, line 17, "unable" should read --usable--.

Signed and Sealed this

Twenty-first Day of March, 2000

*Attest:*

*Attesting Officer*

Q. TODD DICKINSON

*Commissioner of Patents and Trademarks*